US005588946A

United States Patent [19]

Graham et al.

[11] Patent Number: 5,588,946

[45] Date of Patent: Dec. 31, 1996

[54] CENTRIFUGE AND PHASE SEPARATION

[75] Inventors: Gary A. Graham, Rochester; Merrit N. Jacobs, Fairport, both of N.Y.; Russel H. Marvin, Riverton, Wyo.; James D. Shaw, Hilton; Nicholas VanBrunt, Rochester, both of N.Y.

[73] Assignee: Johnson & Johnson Clinical Diagnostics, Inc., Rochester, N.Y.

[21] Appl. No.: 466,640

[22] Filed: Jun. 6, 1995

Related U.S. Application Data

[63] Continuation-in-part of Ser. No. 265,536, Jun. 24, 1994, abandoned.

[51] Int. Cl.[6] ..... B04B 5/02; B04B 13/00

[52] U.S. Cl. ..... 494/11; 494/20

[58] Field of Search ..... 494/1, 11, 12, 494/16, 20, 33, 84, 85

[56] References Cited

U.S. PATENT DOCUMENTS

| | | | |
|---|---|---|---|
| 1,334,109 | 3/1920 | Mojonnier | 494/20 |
| 2,202,157 | 5/1940 | Levy | 494/20 |
| 3,420,437 | 1/1969 | Blum et al. | 494/20 |
| 3,951,334 | 4/1976 | Fleming et al. | 494/20 |
| 4,141,489 | 2/1979 | Wright | 494/20 |
| 4,236,666 | 12/1980 | Aeschlimann et al. | 494/20 |
| 4,431,423 | 2/1984 | Weyant, Jr. | 494/20 |
| 4,449,964 | 5/1984 | Westberg et al. | 494/16 |
| 4,585,434 | 4/1986 | Cole | 494/20 |
| 4,589,864 | 5/1986 | Cole | 494/20 |
| 5,039,401 | 8/1991 | Columbus et al. . | |
| 5,456,652 | 10/1995 | Eberle | 494/20 |

FOREIGN PATENT DOCUMENTS

| | | | |
|---|---|---|---|
| 0564834A2 | 3/1993 | European Pat. Off. . | |
| 3512848A1 | 4/1985 | Germany . | |
| 527712 | 10/1940 | United Kingdom | 494/20 |

OTHER PUBLICATIONS

Boycott, "Sedimentation of blood corpuscles," vol. 104 of *Nature*, p. 532, Jan. 1920.

Anonymous: Centrifugation process [Zentrifugierverfahren] Research Disclosure 17024, Jun. 1978, pp. 20–21.

*Primary Examiner*—Charles E. Cooley

*Attorney, Agent, or Firm*—Dana M. Schmidt

[57] ABSTRACT

A centrifuge and method of operating it, wherein a patient sample tube is first spun while non-aligned with the centrifugal force to make use of the Boycott effect, and then while aligned with the centrifugal force to allow any gel present between the separated phases to properly seal. A latch is used to hold it in the non-aligned position until the latch is opened.

10 Claims, 5 Drawing Sheets

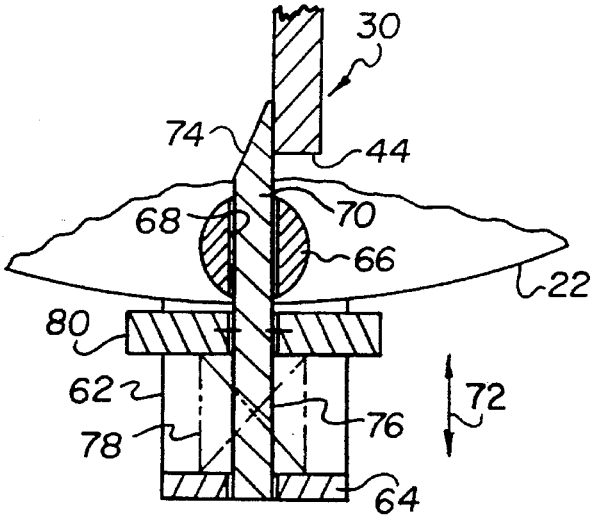
FIG. 3
FIG. 4
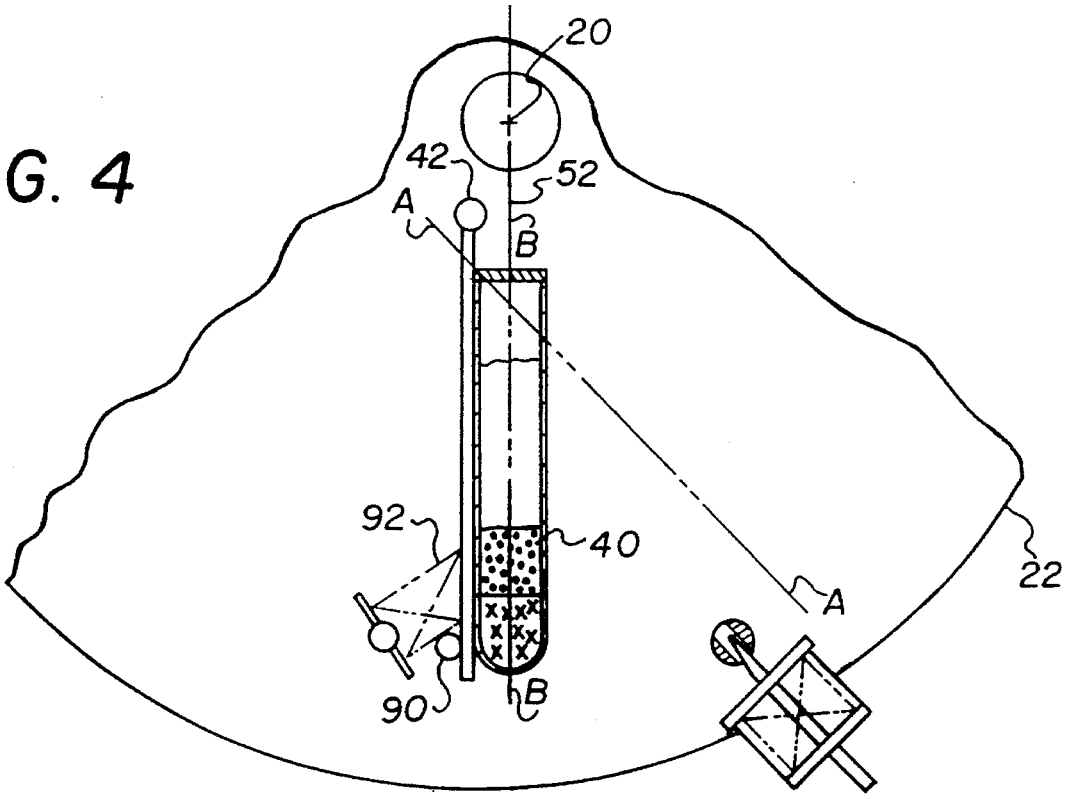

CENTRIFUGE AND PHASE SEPARATION

RELATED APPLICATION

This application is a continuation-in-part application of U.S. Ser. No. 08/265,536 filed on Jun. 24, 1994 now abandoned.

FIELD OF THE INVENTION

This invention relates to centrifuges and methods of achieving phase separation in liquids by centrifuging.

BACKGROUND OF THE INVENTION

When centrifuging blood to achieve phase separation, a stoppered test-tube is commonly used in which the phases separate in response to the centrifugal force, the heavier cells going to the bottom of the tube and the lighter serum or plasma towards the stoppered end. Since 1920, it has been known that the phase separation occurs more rapidly if the axis of the test tube is inclined at an angle, rather than parallel, to the direction of centrifugal force (which extends radially from the rotor). Boycott, "Sedimentation of blood corpuscles," Vol. 104 of *Nature*, p. 532.

Attempts have been made to make use of such more-rapid phase separation, but largely they have relied upon spinning techniques that require specialized separation tubes, such as those shown in U.S. Pat. No. 5,030,341. These require that spinning be about the axis of the tube, thus of course preventing the use of conventional plain tubes.

Furthermore, it has become conventional to use a gel separator in the tube which locates itself between the two phases during centrifuging, to seal them off so that separation is maintained without having to immediately pour off (decant) the supernatant serum. For example, such tubes can be obtained under the trademark "Vacutainer Plus" from Becton-Dickinson. However, those tubes include instructions that state the gel seal is maintained only if the rotor uses a "horizontal head". That is, the gel seal integrity can be relied upon only if the tube is centrifuged so that its long axis is parallel to (aligned with) the direction of centrifugal force. The effect, apparently, is that inclining the long axis at an angle to that centrifuge direction stretches the gel cross-section diameter and reduces its thickness, all of which hinder the formation of an effective seal.

Hence, there are two contradictory effects that, prior to this invention, have not been reconciled: The need to centrifuge a tube with a gel barrier so that the long axis is not aligned with the centrifugal force directions, to make use of the "Boycott" effect noted above for more rapid phase separation; and, the need to centrifuge the tube with the long axis aligned with the force direction, to ensure the gel will seal across the phase boundary. Thus, there has been a need ever since the gel-tube was introduced, to find a way to reconcile these competing interests. (To date, the more traditional approach has been to abandon the Boycott effect in favor of producing a reliable gel seal.)

SUMMARY OF THE INVENTION

We have devised a centrifuge that resolves the aforementioned contradictions and allows a tube to be centrifuged using both effects.

More specifically, in accord with one aspect of the invention there is provided a centrifuge for spinning tubes containing a patient sample, comprising a rotor, a motor operatively connected to the rotor to rotate it about a rotor axis to generate centrifugal forces in directions radiating from the axis, a sample tube holder pivotally mounted at one end on a pivot on the rotor and constructed to hold a patient sample test tube having a long axis, a latch disposed at a location adjacent the end of the holder opposite to the one end, the holder being freely pivotable about the pivot except for the latch, the latch location and the pivot forming a first position for the test tube axis that is misaligned with a radius of the rotor by a non-zero angle of a value up to and including 90° to provide the Boycott effect to a tube in the tube holder when the rotor is rotating, the latch location being farther from the rotor axis than the pivot, the latch comprising a two-position latch operative between a closed position that engages the tube holder and an open position that releases the tube holder, and a stop on the rotor for stopping the free pivoting of the tube holder at a second position in which the test tube axis is generally coincident with a radius of the rotor to allow complete gel seal within the tube.

In accord with another aspect of the invention, there is provided a centrifuge for spinning tubes containing a gel separator and patient sample, comprising a rotor, a motor operatively connected to the rotor to rotate it about a rotor axis to generate centrifugal forces in directions radiating from the axis, a sample tube holder mounted on the rotor to hold a sample tube, and mounting means for mounting the holder at a first position in which the test tube axis is held during rotor rotation in misalignment with radii of the rotor by a non-zero angle up to and including 90°, and at a second position in which the tube axis is generally aligned with a radius of the rotor so that the angle is approximately zero, the mounting means including means for allowing the holder to move from the first position to the second position in response to the rotation of the rotor.

In accord with yet another aspect of the invention, there is provided a method of phase separation of whole blood by spinning the whole blood in a tube having a stoppered end and a long axis and containing patient sample, on a rotor of a centrifuge in a sample tube holder. The method comprises the steps of:

a) mounting the tube in the sample tube holder in a first position in which the tube axis is misaligned with the radii of the rotor by a non-zero angle up to and including 90 degrees, b) spinning the rotor and the tube so mounted while maintaining the tube in the misaligned position so as to provide the Boycott effect to the phases within the tube, c) after step b), altering the position of the tube on the spinning rotor to a second position in which the tube axis is generally aligned with a radius of the rotor, while still spinning the rotor, d) thereafter stopping the spinning.

Accordingly, it is an advantageous feature of the invention that a patient sample can be phase-separated in a tube containing a gel seal, providing both the "Boycott effect" for a more rapid phase separation, AND a reliable gel seal at the phase interface.

It is a related advantageous feature of the invention that a centrifuge and method of spinning are provided which readily switch from the operation that produces the "Boycott effect", to the operation that produces an effective gel seal.

Yet another advantageous feature of the invention is that such switching can be done while centrifuging continues.

Still another advantageous feature of the invention is that such combination of Boycott spinning and gel sealing can be achieved using conventional phase separation tubes rather than specialized tubes requiring that they be spun about the tube axis.

Other advantageous features will become apparent upon reference to the following detailed Description of the Preferred Embodiments, when read in light of the attached drawings.

BRIEF DESCRIPTION OF THE DRAWINGS

FIG. 3 is a fragmentary section view taken generally along the line III—III of FIG. 1;

FIG. 4 is a plan view similar to that of FIG. 2 but illustrating the tube holder in its unlatched position that allows for proper gel sealing at the interface;

DESCRIPTION OF THE PREFERRED EMBODIMENTS

The invention is described hereinafter in connection with the preferred embodiments, in which the liquid being spun in the test tube is whole blood, the test tube is a particular brand tube, only two test tubes are spun at a time, and the stoppered end is closest to the center of spinning. In addition, the invention is applicable regardless of the liquid whose phases are to be separated, regardless of the type of test tube in which it is done, and regardless of the number of tubes used or which tube end is closest to the center of spinning.

Accordingly, the preferred embodiments provide a centrifuge and process of phase-separating whole blood into serum (the supernatant), and blood cells (the heavier phase), using two "Vacutainer Plus" brand tubes T, available from Becton-Dickinson, on the rotor. The invention is based on a design that first spins the tubes while the tube axis is misaligned with the rotor radii (and hence, the direction of centrifugal force) by a non-zero angle alpha, in position "AA"(FIG. 2); and then spins them so that the tube axis is generally aligned with the rotor radius (angle alpha approximately =zero), in position "BB", FIG. 4, all without stopping the rotor to make the change in position. (Angles not exactly zero, e.g., up to about 5 degrees, will still provide effective gel sealing.) Most preferably, the change in position is achieved without even slowing the spinning. Indeed, in the first embodiment, it occurs while increasing the spinning rate.

Figure 1:
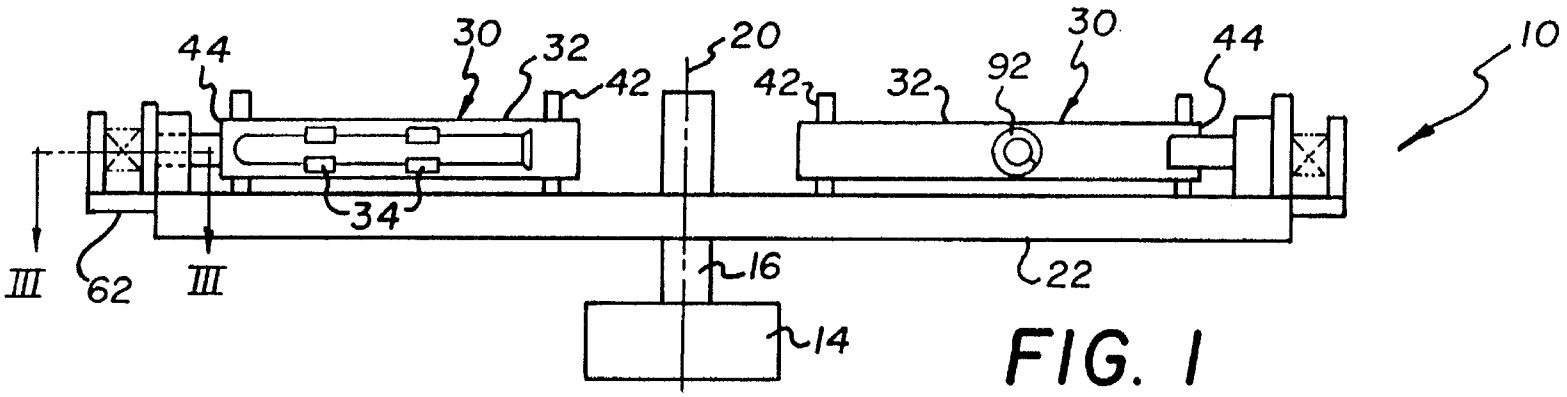
FIG. 1 is an elevational view of a centrifuge, partially broken away at spring 92, constructed in accordance with one embodiment of the invention.
Figure 2:
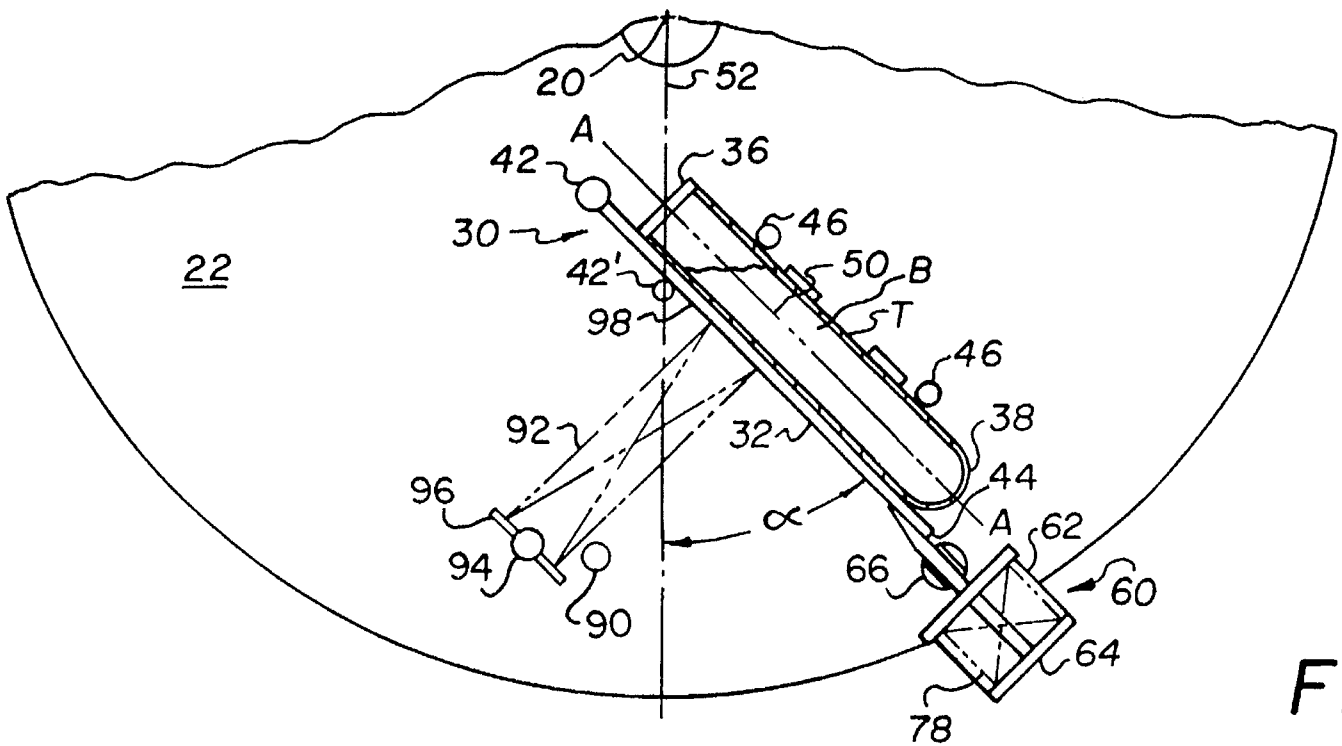
FIG. 2 is a fragmentary plan view of the centrifuge showing the tube in section and the tube holder latched in the position for the "Boycott effect"

Hence, there is provided a centrifuge 10, FIG. 1, comprising as is conventional, a motor 14, a drive spindle 16 having an axis of rotation 20, a rotor 22 affixed to spindle 16, and a plurality (here, two) of test tube holders 30 mounted on the rotor. Such holders 30 preferably and conventionally comprise a base 32 and one or more clips 34 which are, e.g., spring-biased to clamp around a tube T having its stoppered end 36 closer to axis 20 than the unstoppered end 38 (FIG. 2). A gel 40 (FIG. 4) is conventionally included in the tube, which, prior to spinning (not shown), is usually either at end 36 or 38 inside the tube (along with patient sample whole blood B, FIG. 2.)

In accordance with the invention, base 32 of holder 30 is pivotally mounted at or adjacent to end 42 of holder 30 to the rotor 22, with all the tube T extending from beyond pivot end 42 radially outward towards opposite end 44 of base 32. (Position 42' of the pivot illustrates an embodiment in which the pivot is not at end 42, but simply adjacent thereto.) Stops 46 are preferably included to snug holder 30 in the position "AA" with tube axis 50 misaligned by angle alpha to all radii of the rotor, e.g., radius 52. Tube T and tube holder 30 are so held at position "AA" by reason of latch 60 which is operative on ledge 62 extending fixedly from rotor 22, as described below.

Any non-zero value of alpha can be used up to and including about 90°. In the embodiments first illustrated, alpha is less than 90, especially where serum instead of plasma is used. Most preferably, alpha is about 45°.

Latch 60 is preferably constructed as follows, FIG. 3: As noted, a ledge 62 extends out from rotor 22 parallel to position AA, and terminates in an upwardly extending shoulder 64. A pin 66 affixed to rotor 22 inside its circumference is bored with an aperture 68 sized to slidably contain latch member 70 for sliding in the direction of arrows 72. Latch member 70 has a tapered end 74 for engaging end 44 of tube holder base 32, and an opposite end 76 that is either spaced away from shoulder 64 (when the latch is closed), or abutted against it (when the latch is open, FIG. 4). End 76, FIG. 3, is surrounded by a compression spring 78 used to bias end 74 of the latch into the closed position. Spring 78 is compressed between shoulder 64 and a weight 80 staked to latch member 70. Its spring constant is selected, as is well-known, so that it will resist movement of latch 70 back against the spring at first rotational speeds $W_1$, of rotor 22 used for phase separation, but will compress when the speed is $W_2$ greater than $W_1$, so as to unlatch end 74 from holder end 44.

A stop pin 90, FIG. 2, is located on rotor 22 to act as a stop to tube holder 30 when it is unlatched, so that tube axis 50 will become generally aligned (angle alpha =approximately zero) with radius 52 when tube holder 30 is at position "BB", FIG. 4.

Most preferably, a return compression spring 92 is also provided, connected to pin 94 and flange 96 at one end, and to tube holder base 32 at opposite end 98. Its spring constant is sufficient to return base 32 to the A—A position only when rotor 22 is not rotating.

The operation of the centrifuge to achieve the method of the invention, that is, the phase separation by spinning, will be readily apparent from the foregoing. That is, a tube T is inserted onto each tube holder 30, e.g., through the clamps 34, FIG. 1. Holder 30 at this point is latched into the position AA of tube axis 50, because latch member end 74 is fully engaged with end 44 of holder 30, FIG. 2 and 3.

Rotor 22 starts spinning, and is rotated at a rate $W_1$ sufficient to achieve phase separation of the whole blood in tubes T. Because angle alpha is nonzero, the "Boycott effect" speeds up the phase separation, and because spring 78 resists the centrifugal force of this spin rate, position "AA" of tube T is maintained.

Additionally, it can be shown that the Boycott effect aids in moving the gel separator material more quickly to the phase boundary.

After a sufficient time, which is a known function of rate $W_1$ and of the patient sample, the spin rate is increased well above rate $W_1$ to a value $W_2$ at which spring 78 is compressed and latch 60 unlatches, FIG. 4. Tube holder 30 then is forced to pivot about pivot pin 42 against the action of spring 92 until base 32 stops at stop pin 90. Now, tube T has its axis at position BB, wherein angle alpha equals approximately zero and the tube axis is generally aligned with radius 52. It is this spin position that allows gel 40 to re-orient itself into its optimum sealing position between the phases. Spinning continues at this rate for a known amount of time, which varies depending on the kind and amount of gel that is used. Then, spinning ceases and spring 92 takes over and forces tube holder 30 to return to its position AA, FIG. 2, where it is re-latched by latch 60 because of the bevel on end 74.

Spin rates and times are variable and readily determined for given conditions. The following example is merely illustrative:

For a tube volume of 5 ml of whole blood, a spin rate $W_1$ of about 10,000 RPM (1200 G's) is used for about 2 min, after which the rate is increased to $W_2$=11,000 RPM to cause reorientation of the tube, say for 1 min, after which spinning returns to 10,000 RPM for the time needed to reseal the gel, e.g., about 30 sec.

It is not necessary that the unlatching of latch 60 be achieved solely in response to an increased centrifugal force. Alternatively, a timing mechanism can be used to operate a solenoid, the timing mechanism being itself started in response to the centrifugal force. Parts similar to those previously described bear the same reference numerals to which the distinguishing suffix "A" is appended.

Figure 5:
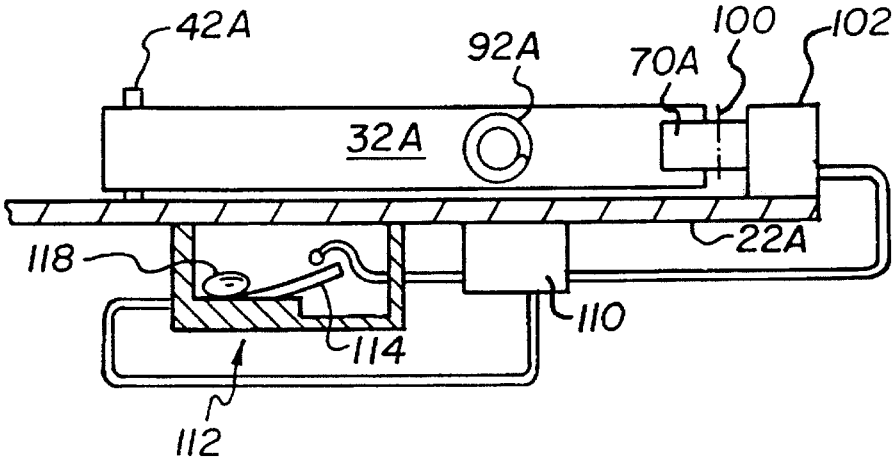
FIG. 5 is a fragmentary elevational view in section, similar to that of FIG. 1, but showing an alternate embodiment.
Figure 6:
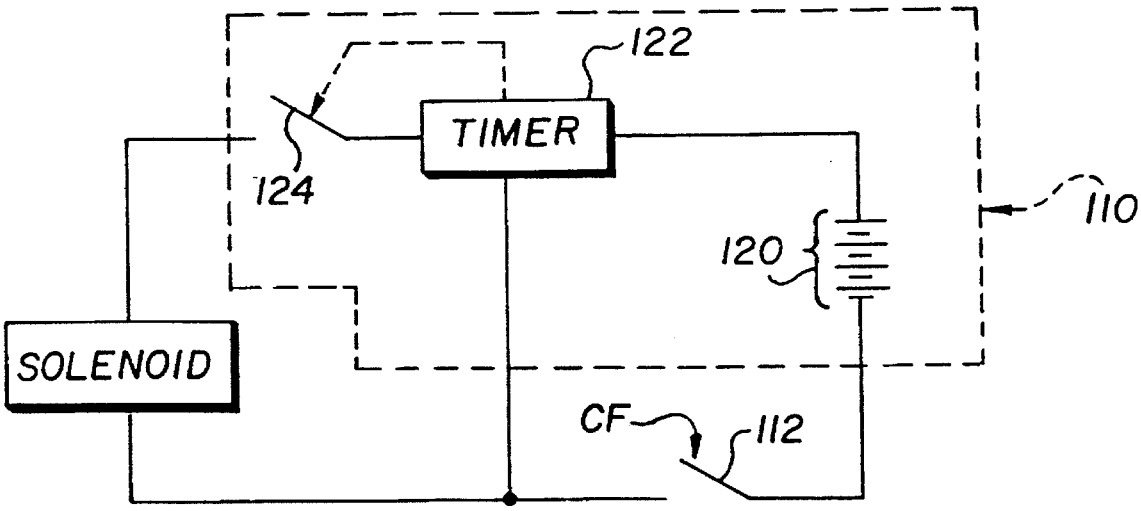
FIG. 6 is a circuit diagram of electrical components used in the embodiment of FIG. 5.

Thus, FIGS. 5 and 6, a rotor 22A is constructed exactly as described above with a base 32A, FIG. 5, that clamps into a tube T (not shown), the base being latched by a latch 70A into position A—A. When latch 70A is unlatched, i.e., withdrawn to the phantom position 100, base 32A and its tube pivot about pivot end 42A against the return spring 92A (only partially shown) to allow the patient tube to align with a radius of the rotor, all as in the previous embodiment.

However, unlike the previous embodiment, latch 70A is directly operated not in response to increased centrifugal force, but rather in response to a fixed increment of time, even at the original rate of spin $W_1$. That is, a solenoid 102 is connected to latch 70A to unlatch it upon power-up, which occurs through the use of circuit 110 and mercury switch 112. Switch 112 is a 2-pole switch with a mercury connector 118 on radially extending ramp 114. Ramp 114 induces connector 118 to stay in its open position except when only a small centrifugal force CF is induced, FIG. 6, by providing rotor 22A with rate of spin $W_3 \ll W_1$. At this time, the centrifugal force CF forces the mercury 118, FIG. 5, of switch 112 to climb ramp 114 to its closed position, at which time a battery 120, FIG. 6, starts timer 122. After timer 122 reaches a pre-set value, it closes its switch 124 which places solenoid 102 in series with battery 120 and latch 70A is unlatched. When rotor 22A stops spinning, switch 112 automatically opens because the mercury falls back to the "start" position, deactivating the timer and the solenoid, which are both spring-based to return to their zero value and latching position, respectively. Because the draw on battery 120 is only that needed to operate for a short time timer 122 (e.g., for about three minutes) and a solenoid, a small battery will suffice for battery 112, e.g., about 9 volts.

Alternatively, battery 120 can be replaced with a source of electrical current from an external source through the use of slip rings on rotor 22A (not shown).

Figure 7:
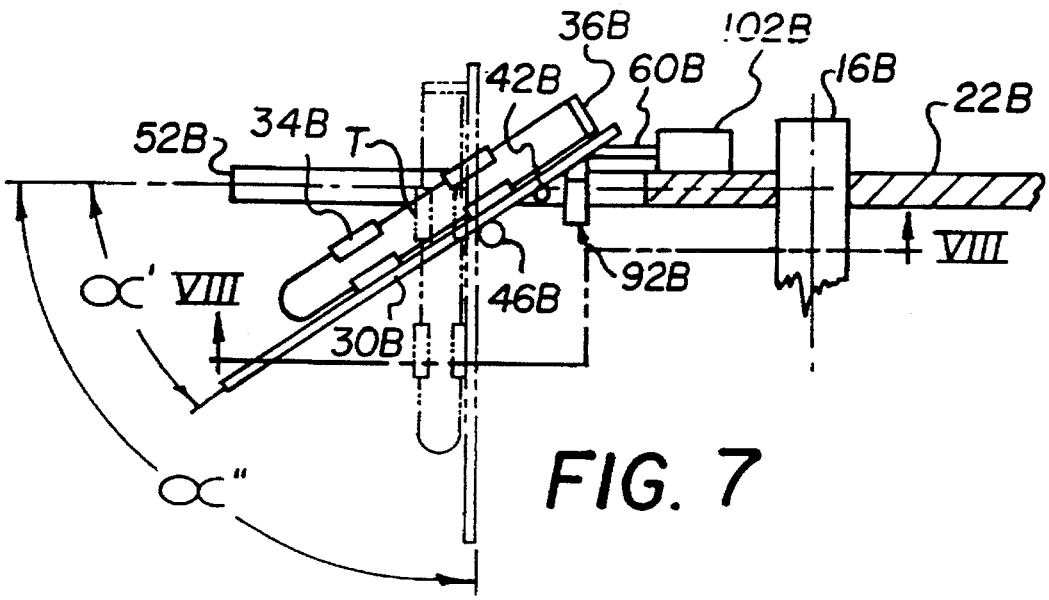
FIG. 7 is a fragmentary elevational view, partially in section, similar to that of FIG. 1 but illustrating another alternate embodiment.
Figure 8:
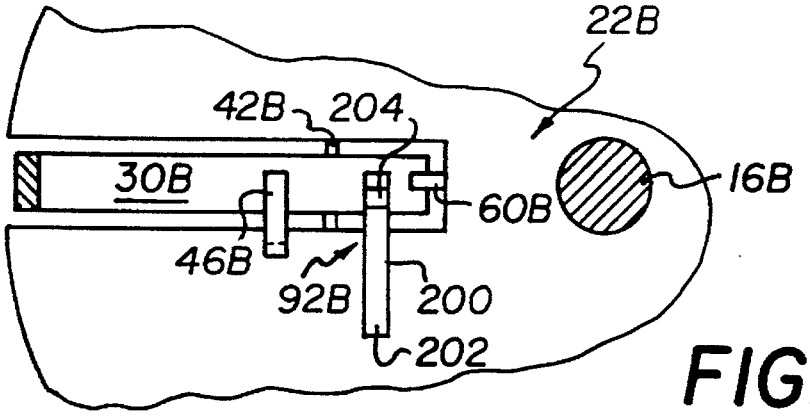
FIG. 8 is a section view taken generally along the line VIII—VIII of FIG. 7.

Still another alternative, FIGS. 7–8, is to mount the tube holder to swing within a plane that is at an angle to the plane of rotation of the rotor, rather than parallel thereto. Parts similar to those previously described bear the same reference numeral, to which the distinguishing suffix "B" is appended.

Thus, rotor 22B is constructed as before on spindle 16B, with a tube holder 30B pivoted at 42B adjacent the end of the holder that preferably holds stoppered end 36B of a tube T, FIG. 7.

A latch 60B keeps holder 30B at an angle alpha' which is misaligned with radius 52B of rotor 22B, except when the latch is opened. Spring biasing means 92B is supplied to return holder 30B to its misaligned position when rotation ceases, all as generally provided in the previous embodiments. (Latch 60B is preferably operated by a solenoid 102B and a time circuit (not shown) as described for FIGS. 5 and 6.)

However, unlike the previous embodiments, holder 30B pivots about pivot 42B in a plane that is angled with respect to the plane of rotation of rotor 22B, and most preferably, at a perpendicular angle thereto. As before, angle alpha' is preferably less than 90° and allows the Boycott effect to operate. When latch 60B opens, holder 30B is free to pivot about pivot 42B to generally align itself, and tube T, with radius 52B, to cause optimum sealing of the gel in tube T.

In fact, the centrifugal force generated by the spinning induces this alignment. Spring means 92B is preferably a leaf spring with an L-shape and a spring constant selected to be ineffective in resisting the centrifugal force's action causing the re-alignment of holder 30B with radius 52B, but effective to return holder 30B to the misaligned position of FIG. 7, when spinning stops. Thus, FIG. 8, the leaf spring preferably comprises a long leg 200 pinned to rotor 22B at 202, and a short leg 204 extending up into contact with holder 30B.

An L-shaped finger 46B attached to the underside of rotor 22B preferably is used to stop holder 30B from pivoting under gravity, when rotor 22B is at rest, beyond angle alpha'.

Yet another alternative, not shown, is to use an outboard latch that permanently engages opposite end 4B, FIG. 7, the latch then being indexed upward to raise the tube holder to its generally aligned radius-position after spinning sufficiently to achieve the Boycott effect. Such a permanently engaging latch could also lower the tube holder past angle alpha' when the rotor is at rest, to allow the operator to load and unload tubes T from the tube holders while vertical. In such a case, the invention is useful for spinning tubes lacking a gel separator.

Figure 9:
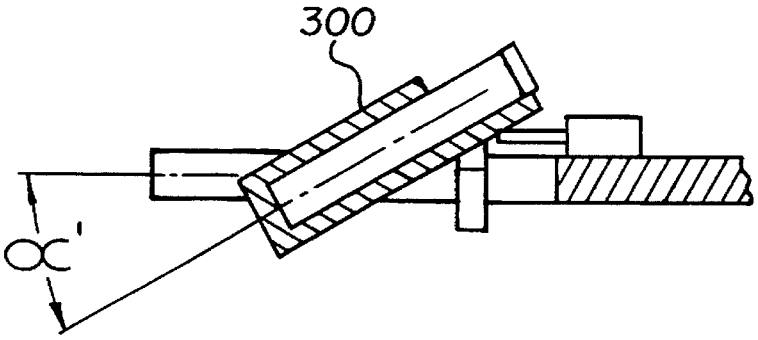
FIG. 9 is a view similar to that of FIG. 7, but of still another embodiment.

Still another alternative for all of the above-described embodiments regarding FIG. 7, is that holder 30B and clips 34B can be replaced with a bucket 300, FIG. 9, which pivots through angle alpha' as described above.

It will be readily appreciated that angle alpha can be as large as 90 degrees, particularly when using the embodiment of FIG. 7 and using plasma instead of serum. Such is shown in detail in FIG. 10, and in phantom in FIG. 7. Parts similar to those previously described bear the same reference numeral to which the distinguishing suffix "C" is appended.

Figure 10:
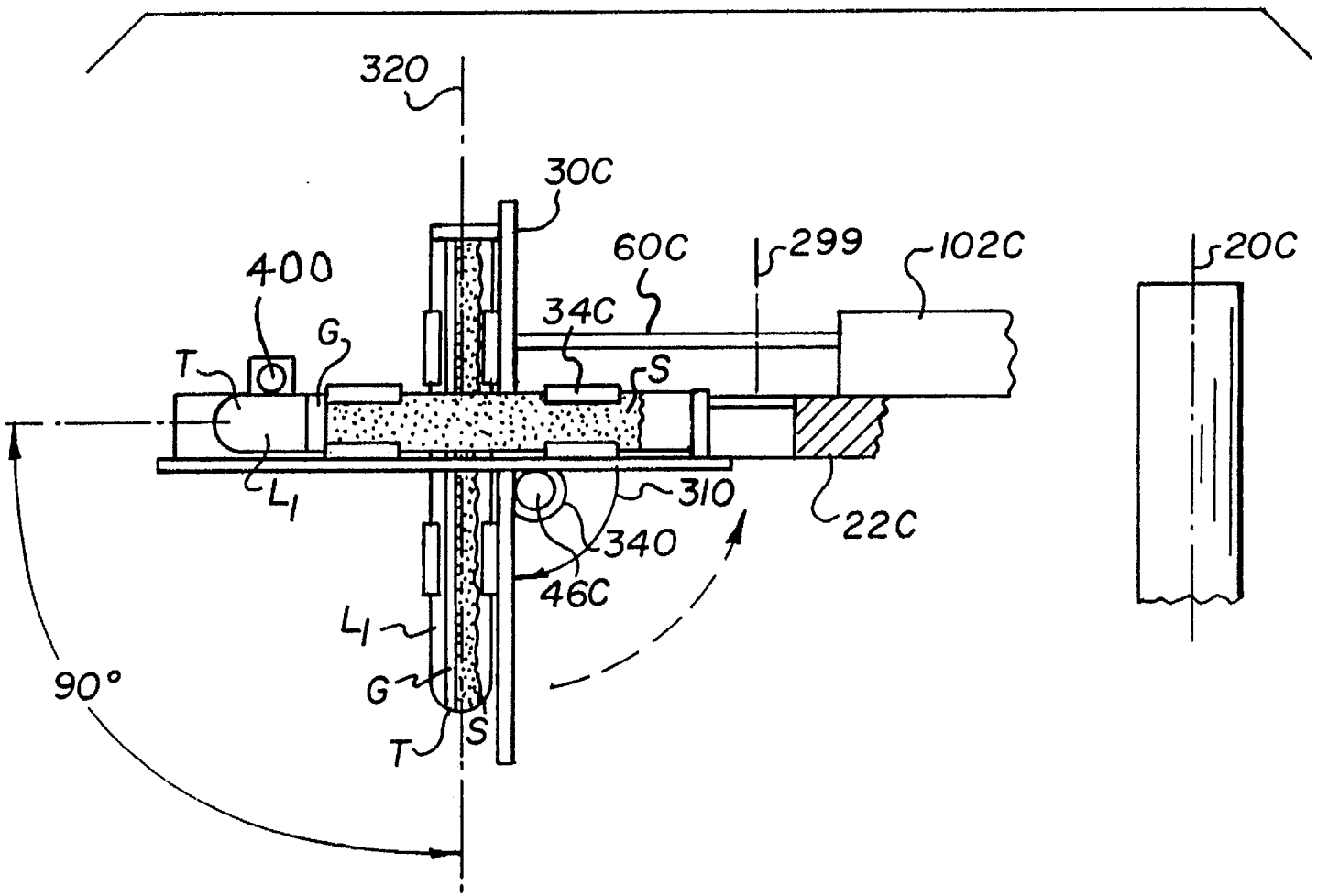
FIG. 10 is a view similar to that of FIG. 7, but showing yet another embodiment in which the nonaligned angle is 90 degrees.

Thus, in FIG. 10, the tube holder 30C swings about pivot 46C when released by latch 60C and solenoid 102C, arrow 310, as in the embodiment of FIG. 7. (Latch 60C pulls back to the position shown at plane 299, when holder 30C is to be released.) However, the initial position of latch 60C is one in which the holder 30C and tube T are vertical, that is, angle alpha is 90 degrees non-aligned with the radii of rotor 22C. This allows the maximum Boycott effect to occur as the path length for diffusion is the minimum when the tube axis 320 is aligned with the axis of spin. When the tube is then later aligned with the radius of rotor 22C, the gel G can reform properly for sealing off the two phases. (This is illustrated by showing the thin cell containing layer L1, the barrier gel layer G, and the serum or plasma layer S, in both tube positions.)

To minimize the force of the swing of tube T when latch 60C is released, the spring 92B of the previous embodiment is preferably replaced with a torsion spring 340 mounted on pivot 46C. Spring 340 also acts to return the tube to an upright position for ease in removing, once centrifuging is complete. By proper selection of the spring constant, spring 340 can act to slow the pivoting of the tube so that it requires several seconds to move between the two positions shown.

An optional stop 400 is added on the top of the rotor to keep the tube T from swinging out of alignment with the rotor radius, when released by latch 60C. The top of the tube is always closer to spin axis 20C than the bottom, when so released, by reason of the location of pivot 46C being closer to the top than the bottom of the tube.

Using the vertical position as the initial position to obtain a 90 degree orientation, is preferred over the use of rotation of tube T through only a horizontal plane between the 90 and zero angle positions. The reason is that the latter case can result in the stopper being the trailing component during spinning. Such an orientation risks the stopper being forced loose due to the action of the centrifugal force. In contrast, mounting the tube vertically with the stopper above the rest of the tube, avoids that effect. Even so there can still be a force applied to the stopper from the liquid under centrifugation, and optionally a holder plate, not shown, can be placed above the stopper as part of the tube holder, to avoid stopper dislodging.

The invention has been described in detail with particular reference to preferred embodiments thereof, but it will be understood that variations and modifications can be effected within the spirit and scope of the invention. For example, although other features can be added besides those described, it is also useful free of any other features. That is, it can consist of only the enumerated parts.

What is claimed is:

1. A centrifuge for spinning tubes containing a gel separator and patient sample, comprising a rotor, a motor operatively connected to said rotor to rotate it about a rotor axis to generate centrifugal forces in directions radiating from said axis, a sample tube holder pivotally mounted adjacent to one end on a pivot on said rotor and constructed to hold a patient sample test tube having a long axis, a latch disposed at a location adjacent the end of said holder opposite to said one end in position to removably engage said holder, said holder being freely pivotable about said pivot except when engaged by said latch, said latch location and said pivot forming a first position for said test tube axis that is misaligned with a radius of said rotor by a non-zero angle up to and including 90° to provide the Boycott effect to sample test tube in said tube holder when said rotor is rotating, said latch location being farther from said rotor axis than said pivot, said latch comprising a two-position latch operative between a closed position that engages said tube holder and an open position that releases said tube holder, and a stop on said rotor for stopping the free pivoting of said tube holder at a second position in which said test tube axis is generally coincident with a radius of said rotor to allow complete gel seal within said tube.

2. A centrifuge as defined in claim 1, and further comprising moving means on said rotor for moving said latch from its closed position to its open position after sufficient centrifuging has occurred to achieve phase separation in said sample tube.

3. A centrifuge as defined in claim 2, wherein said moving means includes a weight slidably mounted on said rotor and connected to said latch to move to unlatch said latch in response to increased centrifugal force.

4. A centrifuge as defined in claim 2, wherein said moving means includes a solenoid connected to said latch, a timer, a switch responsive to any centrifugal force to activate the timer, and circuit means for activating said solenoid when said timer reaches a pre-set value.

5. A centrifuge as defined in claim 1, and further including a spring for returning said tube holder to said first position.

6. A centrifuge as defined in claim 1, wherein said latch holds said tube vertically, aligned with said rotor axis, when said tube is in said first position.

7. A centrifuge for spinning tubes containing a gel separator and patient sample, comprising a rotor, a motor operatively connected to said rotor to rotate it about a rotor axis to generate centrifugal forces in directions radiating from said axis, a sample tube holder pivotally mounted adjacent to one end on a pivot on said rotor and constructed to hold a patient sample test tube having a long axis, a latch disposed at a location adjacent the end of said holder opposite to said one end in position to removably engage said holder, said holder being freely pivotable about said pivot except when engaged by said latch, said latch location and said pivot forming a first position for said test tube axis that is misaligned with a radius of said rotor by a non-zero angle to provide the Boycott effect to a sample test tube in said tube holder when said rotor is rotating, said latch location being farther from said rotor axis than said pivot, and moving means on said rotor for unlatching and opening said latch in response to a predetermined centrifugal force generated by spinning said rotor, said moving means including a weight slidably mounted on said rotor and connected to said latch to move to unlatch said latch in response to a predetermined centrifugal force in excess of force generated by rotating for said Boycott effect.

8. A centrifuge as defined in claim 7, and further including a stop on said rotor for stopping the free pivoting of said tube holder at a second position in which said test tube axis is generally coincident with a radius of said rotor to allow complete gel seal within said tube.

9. A centrifuge for spinning tubes containing a gel separator and patient sample, comprising a rotor, a motor operatively connected to said rotor to rotate it about a rotor axis to generate centrifugal forces in directions radiating from said axis, a sample tube holder pivotally mounted adjacent to one end on a pivot on said rotor and constructed to hold a patient sample test tube having a long axis, a latch disposed at a location adjacent the end of said holder opposite to said one end in position to removably engage said holder, said holder being freely pivotable about said pivot except when engaged by said latch, said latch location and said pivot forming a first position for said test tube axis that is misaligned with a radius of said rotor by a non-zero angle to provide the Boycott effect to a sample test tube in said tube holder when said rotor is rotating, said latch location being farther from said rotor axis than said pivot, and moving means on said rotor for unlatching and opening said latch in response to a predetermined centrifugal force generated by spinning said rotor, said moving means including a solenoid connected to said latch, a timer, a switch responsive to any centrifugal force to activate the timer, and circuit means for activating said solenoid when said timer reaches a pre-set value.

10. A centrifuge for spinning tubes having a longitudinal axis containing patient sample, comprising a rotor, a motor operatively connected to said rotor to rotate it about a rotor axis to generate centrifugal forces in directions radiating from said axis, a sample tube holder mounted on said rotor to hold a sample tube, and mounting means for mounting said holder at a first position in which said test tube axis is held during rotor rotation in misalignment with radii of said rotor by a non-zero angle and at a second position in which said tube axis is generally aligned with a radius of said rotor so that said angle is approximately zero, said mounting means including allowing means for allowing said holder to move from said first position to said second position in response to centrifugal force generated by rotating said rotor, said allowing means including a timer, a switch responsive to any centrifugal force to activate the timer, and circuit means for activating said solenoid when said timer reaches a pre-set value.

* * * * *